US007206535B2

(12) United States Patent
Nozawa

(10) Patent No.: US 7,206,535 B2
(45) Date of Patent: Apr. 17, 2007

(54) DEVELOPING DEVICE AND IMAGE FORMING APPARATUS

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/146,089

(22) Filed: Jun. 7, 2005

(65) Prior Publication Data

US 2005/0276627 A1 Dec. 15, 2005

(30) Foreign Application Priority Data

Jun. 14, 2004 (JP) ..... 2004-175102

(51) Int. Cl.
*G03G 15/08* (2006.01)

(52) U.S. Cl. ..... 399/103; 399/105

(58) Field of Classification Search ..... 399/98, 399/102, 103, 106, 105
See application file for complete search history.

(56) References Cited

U.S. PATENT DOCUMENTS 5,740,499 A * 4/1998 Higeta et al. ..... 399/105
6,115,566 A * 9/2000 Ohara et al. ..... 399/103

FOREIGN PATENT DOCUMENTS

| | | | |
|---|---|---|---|
| EP | 0 881 549 A1 | | 12/1998 |
| EP | 1 347 347 A2 | | 9/2003 |
| JP | 07-333988 | | 12/1995 |
| JP | 07334056 A | * | 12/1995 |
| JP | 11-338253 | | 12/1999 |
| JP | 11338253 A | * | 12/1999 |
| JP | 2005031432 A | * | 2/2005 |

* cited by examiner

*Primary Examiner*—David M. Gray
*Assistant Examiner*—Bryan Ready
(74) *Attorney, Agent, or Firm*—Rabin & Berdo, PC

(57) ABSTRACT

A developing device includes a photosensitive body (18) on which a latent image formed, and a developing roller (2) that rotates to supply a toner to the photosensitive body (18). Seal members (6*a*) are provided on both end portions of the developing roller (2). The thickness of each seal member (6*a*) increases along the rotational direction of the developing roller (2) from the upstream to the downstream, so that the pressure with which the seal member (6*a*) is pressed against the developing roller (2) increases along the rotational direction of the developing roller (2) from the upstream to the downstream.

22 Claims, 6 Drawing Sheets

DEVELOPING DEVICE AND IMAGE FORMING APPARATUS

BACKGROUND OF THE INVENTION

This invention relates to an image forming apparatus such as an electrophotographic apparatus, and particularly to a technology for preventing the leakage of a toner from a developing device of the image forming apparatus.

Generally, a developing device used in an image forming apparatus (for example, an electrophotographic apparatus) includes a developing roller that supplies a toner to a photosensitive drum, and a supply roller that supplies the toner stored in a toner storing portion to the developing roller. In order to prevent the toner moving outward in the axial direction of the developing roller from leaking out of the developing device, seal members are fixed to a casing of the developing device. The seal members slidably contact a circumferential surface of both ends of the developing roller. If the contact area between the seal members and the circumferential surface of the developing roller is increased, the effect of preventing the leakage of the toner is enhanced. However, in such a case, the friction between the seal members and the circumferential surface of the developing roller may increase, and therefore a load torque of a motor for driving the developing roller may also increase. As a result, the motor may become larger, and the abrasive wear may increase.

In order to solve this problem, it is proposed to form a hole or a cutout portion on each seal member 102 as shown in FIG. 10 (for example, Japanese Laid-open Patent Publication No. 7-333988: Patent Document 1). The hole or cutout portion is formed on the upstream side of each seal member 102 along the rotational direction of the developing roller 101. The contact area between the seal member 102 and the circumferential surface of the developing roller 101 is larger on the downstream side than on the upstream side, so that a large sealing effect is obtained on the downstream side of the seal member 102. With such a structure, a large sealing effect can be partially obtained, and the whole contact area between the seal member 102 and the circumferential surface of the developing roller 101 can be small.

Moreover, it is also proposed to provide separate seal members 103 and 104 respectively on the upstream side and on the downstream side along the rotational direction of the developing roller 101 as shown in FIG. 11 (for example, Japanese Laid-open Patent Publication No. 11-338253: Patent Document 2). The toner adhering to the circumferential surface of the developing roller 101 between the seal members 103 and 104 may freely falls from the circumferential surface of the developing roller 101, and the toner having reached the seal member 104 may be scraped off by the seal member 104. The whole contact area between the seal members 103 and 104 and the circumferential surface of the developing roller 101 can be small.

However, the seal member 102 (FIG. 10) disclosed in Patent Document 1 may be breakable because the seal member 102 has the hole or the cutout portion. In addition, the seal member 102 is bonded to a casing of the developing device with a small bonding area, and therefore the seal member 102 may easily be separated from the casing of the developing device.

Moreover, it is also proposed to provide separate seal members 103 and 104 respectively on the upstream side and on the downstream side along the rotational direction of the developing roller 101 as shown in FIG. 11 (for example, Japanese Laid-open Patent Publication No. 11-338253: Patent Document 2). The toner adhering to the circumferential surface of the developing roller 101 between the seal members 103 and 104 may freely fall from the circumferential surface of the developing roller 101, and the toner having reached the seal member 104 may be scraped off by the seal member 104. The whole contact area between the seal members 103 and 104 and the circumferential surface of the developing roller 101 can be small.

SUMMARY OF THE INVENTION

An object of the present invention is to provide a developing device and an image forming apparatus capable of preventing the leakage of a toner outward in the axial direction of the developing roller without increasing a torque for rotating the developing roller.

The present invention provides a developing device for developing a latent image formed on a photosensitive body. The developing device includes a developing roller that rotates to supply a toner to the photosensitive body, and at least one seal member that slidably contacts a circumferential surface of at least one end portion of the developing roller. A pressure with which the seal member is pressed against the circumferential surface of the developing roller continuously increases along a rotational direction of the developing roller from the upstream to the downstream thereof.

With such an arrangement, it becomes possible to obtain a developing device capable of preventing the leakage of the toner outward in the axial direction of the developing roller without increasing the torque for rotating the developing roller. Further, by using the developing device, it becomes possible to reduce the size and the manufacturing cost of the image forming apparatus.

DETAILED DESCRIPTION OF THE PREFERRED EMBODIMENT

Embodiments of the present invention will be described with reference to the attached drawings.

Embodiment 1

Figure 1:
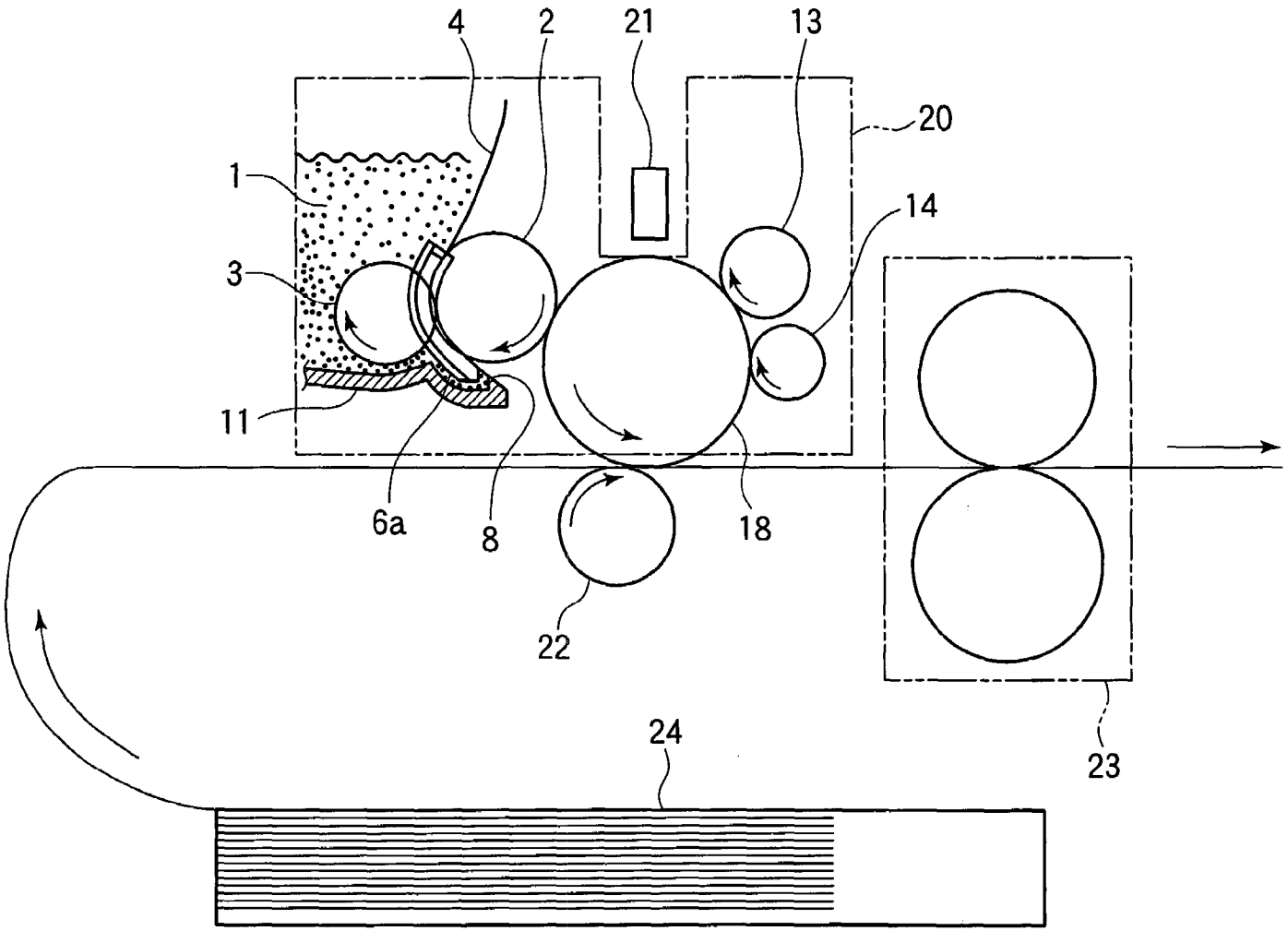
FIG. 1 is a side view showing a configuration of an image forming apparatus according to Embodiment 1 of the present invention.

FIG. 1 is a side view showing a configuration of an image forming apparatus according to Embodiment 1 of the present invention. As shown in FIG. 1, the image forming apparatus includes an image forming cartridge 20 detachably attached to a main body of the image forming apparatus, an exposing device 21, a transferring device 22, a fixing device 23 and a medium feeding device 24.

The image forming cartridge 20 includes a toner storing portion 1 in which a toner (i.e., a developer) is stored, a developing roller 2 having a conductive metal shaft on which a semiconductive rubber (such as silicone rubber) is formed, and a supply roller 3 made of a sponge-like rubber (to which a foaming agent has been added in a kneading process for enhancing the ability to carry the toner) formed into the shape of a roller. The image forming cartridge 20 further includes a developing blade 4 that uniformly regulates the thickness of a toner layer formed on the developing roller 2, seal members 6*a* for preventing the leakage of the toner, and a film member 8 that seals the gap between the developing roller 2 and the bottom wall 11 of the toner storing portion 1. The toner storing portion 1, the developing roller 2, the supply roller 3, the developing blade 4, the seal members 6*a*, and the film member 8 constitute a developing device for developing a latent image described later.

The image forming cartridge 20 further includes a photosensitive drum 18 having a conductive base made of aluminum or the like and a surface layer made of organic photosensitive material laminated on the conductive base, a charging device 13 having a charging roller made of a semiconductive rubber (such as Epichlorohydrin rubber) formed on a conductive metal shaft in the shape of a roller, and a cleaning roller 14. The charging device 13 and the above described exposing device 21 constitute a latent image forming device that forms a latent image on the photosensitive drum 18.

The charging roller of the charging device 13, the developing roller 2 and the cleaning roller 14 rotate in contact with the circumferential surface of the photosensitive drum 18. As indicated by arrows in FIG. 1, the developing roller 2 and the supply roller 3 rotate in the same directions (clockwise in FIG. 1) by a not shown rotation driving mechanism.

Predetermined bias voltages are applied to the developing roller 2, the supply roller 3 and the developing blade 4 by not shown power sources (i.e., a developing roller power source, a supply roller power source and a developing blade power source). It is preferable to use spherical toner whose mean particle diameter is from 5 to 10 μm, in order to obtain high flowablity.

In the image forming apparatus, the charging device 13 uniformly charges the circumferential surface of the photosensitive drum 18, and the exposing device 21 exposes the circumferential surface of the photosensitive drum 18 according to image information, so that a latent image is formed on the circumferential surface of the photosensitive drum 18. The toner stored in the toner storing portion 1 is supplied to the developing roller 2 by the supply roller 3. The developing roller 2 supplies the toner to the circumferential surface of the photosensitive drum 18 so that a latent image is developed with the toner. The toner image formed on the circumferential surface of the photosensitive drum 18 is transferred to the recording medium (fed by the medium feeding device 24) by the transferring roller 22, and is fixed to the recording medium by the fixing device 23. The residual toner that remains on the photosensitive drum 18 after the transferring is removed therefrom by the cleaning roller 14.

The structure and operation of the seal members 6*a* will be described.

The seal members 6*a* are provided for preventing the toner from leaking outwardly from both end portions of the developing roller 2 in the axial direction. As shown in FIG. 1, the seal members 6*a* extend along a part of the circumference of the photosensitive drum 18 that faces the toner storing portion 1. The position where the supply roller 3 substantially contacts the photosensitive drum 18 is located between an upstream end and a downstream end of the seal members 6*a* in the rotational direction of the developing roller 2. The film member 8 is substantially located on the upstream end of the seal members 6*a*, and the developing blade 4 is substantially located on the downstream end of the seal members 6*a*.

The seal members 6*a* at both end portions of the developing roller 2 are constructed in a symmetrical manner. Therefore, one of the seal members 6*a* will be described below.

Figure 2A:
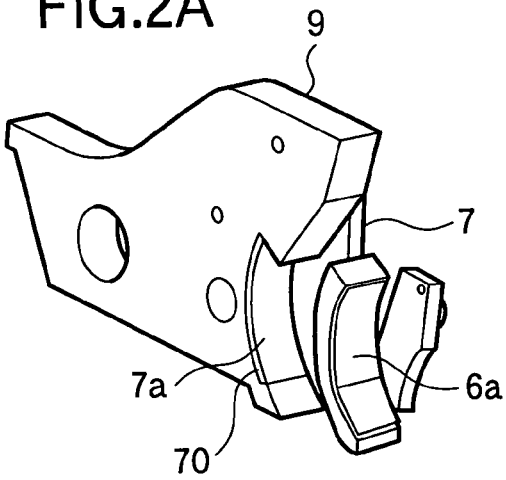
FIGS. 2A and 2B are perspective views showing a side seal member and a seal member respectively contacting an end surface and a circumferential surface of a developing roller of the image forming apparatus according to Embodiment 1.
Figure 2B:
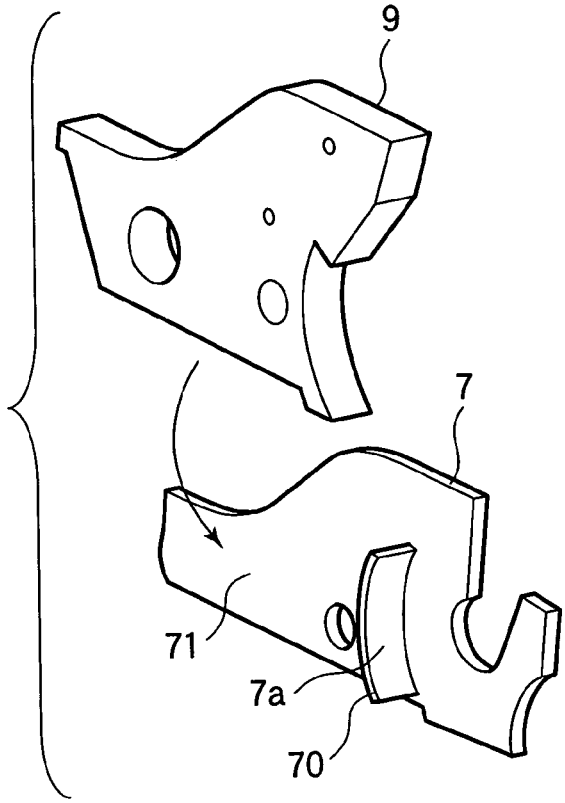

FIGS. 2A and 2B are perspective views showing the seal member 6*a* mounted in the image forming apparatus. The seal member 6*a* is bonded to a bonding surface 7*a* of a side plate 7 of a casing of the image forming cartridge 20. The side plate 7 is made of a molded synthetic resin (i.e., plastic). The side plate 7 has a surface 71 (FIG. 2B) that faces an end surface of the developing roller 2. The bonding surface 7*a* is formed on a plate-like mounting piece 70 fixed to the surface 71 of the side plate 7. The seal member 6*a* is made of, for example, a sponge shaped urethane. The side plate 7 rotatably supports the developing roller 2 and the supply roller 3 or the like. As shown in FIG. 2B, a side seal member 9 is bonded to the surface 71 of the side plate 7. The side seal member 9 is made of sponge shaped urethane. The hardness of the side seal member 9 is harder than that of the seal member 6*a*.

Figure 3:
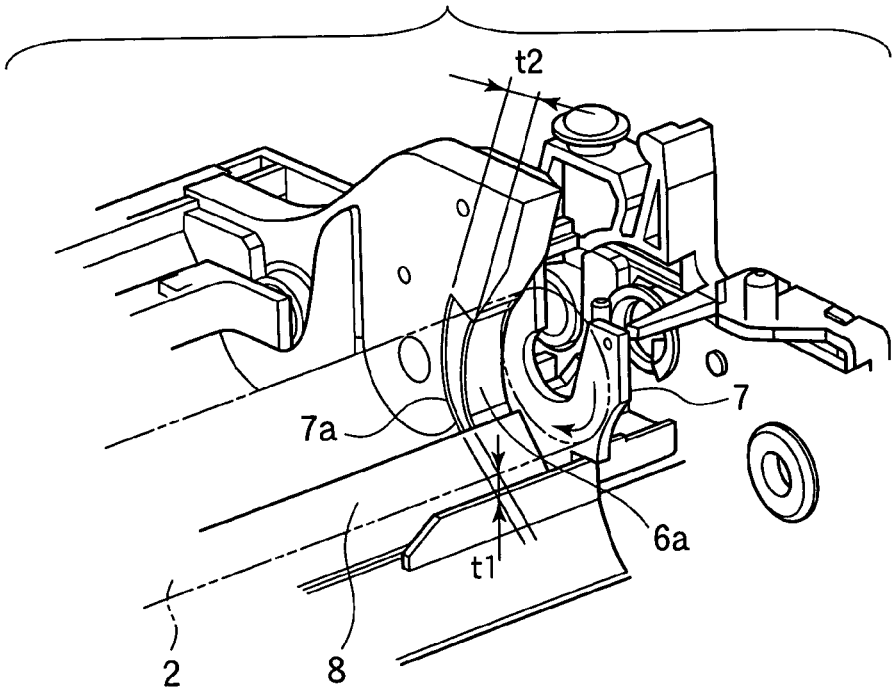
FIG. 3 is a perspective view showing the seal member mounted in the image forming apparatus according to Embodiment 1.
Figure 4:
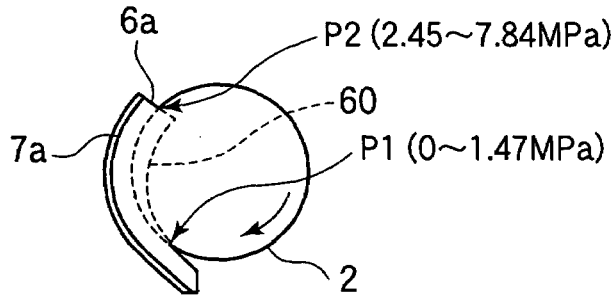
FIG. 4 is a schematic view showing a compressed amount of a compressed portion of the seal member of the image forming apparatus according to Embodiment 1.
Figure 5:
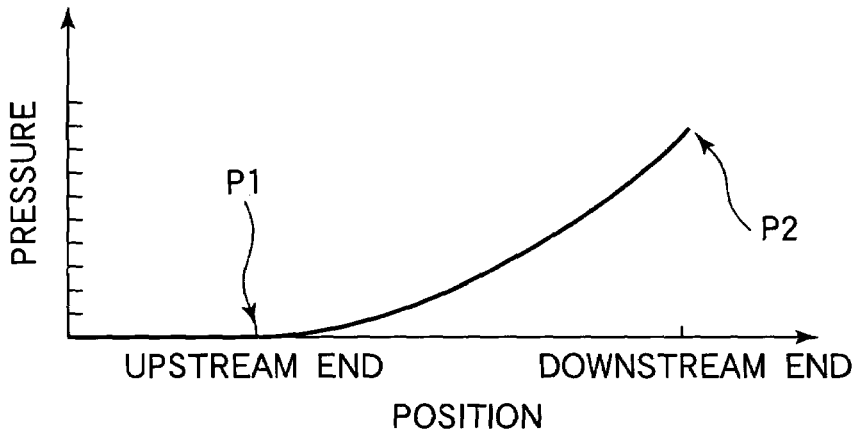
FIG. 5 is a graph showing a distribution of a pressure with which the seal member is pressed against the developing roller of the image forming apparatus according to Embodiment 1.

FIG. 3 is a perspective view of the seal member 6*a* mounted in the image forming apparatus. FIG. 4 is a schematic view showing the seal member 6*a* and the developing member 2. As shown in FIG. 3, the thickness of the seal member 6*a* continuously increases from t1 to t2 (t2>t1) along the rotational direction of the developing roller 2 from the upstream to the downstream. The seal member 6*a* is sandwiched (and compressed) between the circumferential surface of the developing roller 2 and the bonding surface 7*a* of the side plate 7. Thus, as schematically shown in FIG. 4, the compressed amount of a compressed portion 60 (indicated by dashed line in FIG. 4) of the seal member 6*a* continuously increases along the rotational direction of the developing roller 2 from the upstream to the downstream. Accordingly, as shown in FIG. 5, the distribution of the pressure with which the seal member 6*a* is pressed against the developing roller 2 continuously increases along the rotational direction of the developing roller 2 from the upstream to the downstream.

The pressure P1 at the upstream end of the seal member 6*a* is preferably from 0 to 15 kgf/cm$^2$ (i.e., from 0 to 1.47 MPa), and the pressure P2 at the downstream end of the seal member 6*a* is preferably from 25 to 80 kgf/cm$^2$ (i.e., from 2.45 to 7.84 MPa).

By setting the pressure of the seal member 6*a* within the above described range, the toner adhering to the circumferential surface of the developing roller 2 easily enters into a contact portion between the seal member 6*a* and the circumferential surface of the developing roller 2, and the toner having entered into the contact portion tends to remain on the downstream side of the seal member 6*a* without leaking out of the contact portion. In a particular example, the circumferential length of the contact portion between the seal member 6*a* and the circumferential surface of the developing roller 2 is one forth (¼) of the circumference of the developing roller 2. In order to ensure that the pressure of the seal member 6*a* continuously increases along the rotational direction of the developing roller 2 from the upstream to the downstream for obtaining the above described effect, the circumferential length of the contact portion between the seal member 6*a* and the circumferential surface of the developing roller 2 is necessarily longer than or equals to one fifth (⅕) of the circumference of the developing roller 2. The above described effect can be obtained when the pressure of the seal member 6*a* continuously increases, and therefore it is possible that the pressure of the seal member 6*a* linearly increases in FIG. 5.

As shown in FIGS. 2A through 3, the end surface of the developing roller 2 contacts each side seal member 9, and the circumferential surface at each end portion of the developing roller 2 contacts the seal member 6*a*, with the result that the leakage of the toner adhering to the circumferential surface of the developing roller 2 can be prevented. Additionally, the film member 8 is inserted between the bottom wall 11 of the toner storing portion 1 (FIG. 1) and the developing roller 2, and extends in the axial direction of the developing member 2 to thereby seal the gap between the bottom wall 11 and the developing roller 2, so that the sealing effect is further enhanced.

Next, the principle of preventing the leakage of the toner using the seal member 6*a* will be described. When the developing roller 2 rotates, the toner adhering to the circumferential surface of the end portion of the developing roller 2 easily enters into a contact portion between the seal member 6*a* and the circumferential surface of the developing roller 2. At the upstream part of the seal member 6*a*, the pressure of the seal member 6*a* is relatively small as described above, and therefore the toner having entered into the contact portion moves toward the downstream side of the seal member 6*a* without leaking out of the contact portion. The toner having entered into the contact portion stays where a force urging the toner to the downstream side is balanced with another force (caused by the pressure of the seal member 6*a*) preventing the movement of the toner. Accordingly, the toner adhering to the circumferential surface of the developing roller 2 is prevented from leaking out of the toner storing portion 1, i.e., the developing device.

The amount of the toner that enters into the contact portion between the seal member 6*a* and the developing roller 2 is relatively small, so that the sealing effect is not deteriorated during the lifetime of the image forming cartridge 2.

As described above, according to Embodiment 1, the thickness of the seal member 6*a* continuously increases along the rotational direction of the developing roller 2 from the upstream to the downstream, so that the pressure with which the seal member 6*a* is pressed against the developing roller 2 becomes larger on the downstream side of the seal member 6*a*. Thus, it becomes possible to reduce the pressure with which the seal member 6*a* is pressed against the developing roller 2 as a whole, without deteriorating the sealing performance. Moreover, the toner is kept in the contact portion between the seal member 6*a* and the developing roller 2 without being scraped off, and therefore it is not necessary to form a hole or a cutout portion for ejecting the scraped toner, with the result that the seal member 6*a* is not easily broken or separated. Furthermore, it is not necessary to provide separate seal members respectively on the upstream and downstream sides along the rotational direction of the developing roller 2, and therefore the deterioration of the sealing effect because of the displacement of the seal members does not occur.

Embodiment 2

Figure 6:
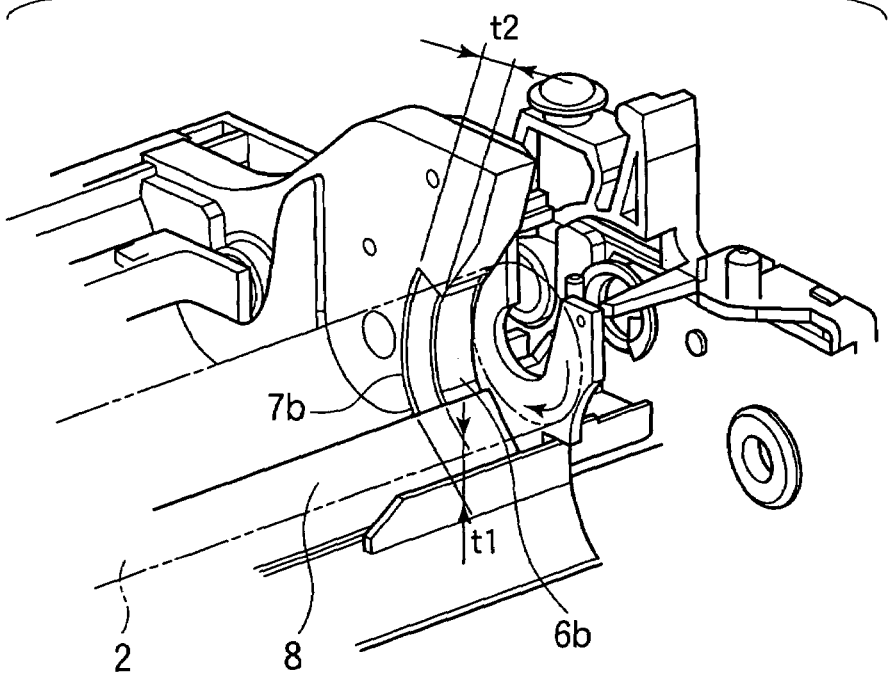
FIG. 6 is a perspective view showing a seal member of an image forming apparatus according to Embodiment 2 of the present invention.
Figure 7:
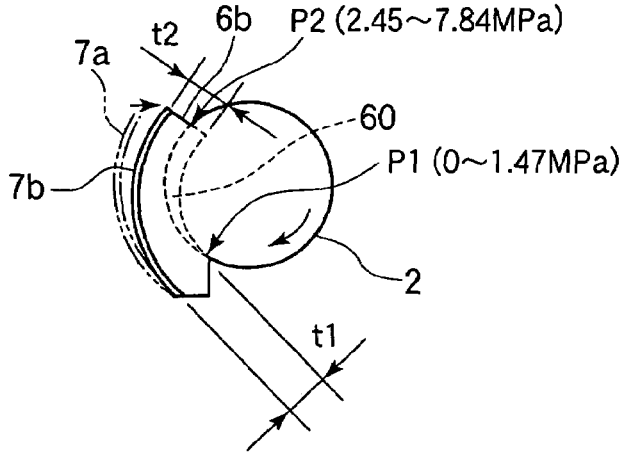
FIG. 7 is a schematic view showing a compressed amount of the compressed portion of the seal member of the image forming apparatus according to Embodiment 2.

FIG. 6 is a perspective view of a seal member 6*b* mounted in an image forming apparatus according to Embodiment 2. FIG. 7 is a side view showing the seal member 6*b* and the developing member 2. In Embodiment 2, the seal member 6*b* is used instead of the seal member 6*a* (FIG. 2) of Embodiment 1. Other components of Embodiment 2 are the same as those of Embodiment 1. The thickness of the seal member 6*b* does not change along the rotational direction of the developing roller 2. In other words, the thickness t1 and t2 of the upstream and downstream ends of the seal member 6*a* are substantially the same.

However, as shown in FIG. 7, a bonding surface 7*b* of the side plate 7 (for bonding the seal member 6*b*) is so shaped that the distance between the bonding surface 7*b* and the rotation axis of the developing roller 2 continuously decreases along the rotational direction of the developing roller 2 from the upstream to the downstream. Thus, in a state where the seal member 6*b* is not compressed by the developing roller 2, the contact surface of the seal member 6*b* (contacting the developing roller 2) and the rotation axis of the developing roller 2 continuously decreases along the rotational direction of the developing roller 2 from the upstream to the downstream. With such a structure, the compressed amount of a compressed portion 60 (indicated by dashed line in FIG. 7) of the seal member 6*b* increases along the rotational direction of the developing roller 2 from the upstream to the downstream. Accordingly, the distribution of the seal member 6*b* in which the pressure continuously increases along the rotational direction of the developing roller 2 from the upstream to the downstream is obtained. The pressure P1 at the upstream end of the seal member 6*b* is preferably from 0 to 15 kgf/cm$^2$ (i.e., from 0 to 1.47 MPa), and the pressure P2 at the downstream end of the seal member 6*b* is preferably from 25 to 80 kgf/cm$^2$ (i.e., from 2.45 to 7.84 MPa).

According to Embodiment 2, the distance between the contact surface of the seal member 6*b* (in a state where the seal member 6*b* is not compressed) and the rotation axis of the developing roller 2 continuously decreases along the rotational direction of the developing roller 2 from the upstream to the downstream, with the result that the pressure with which the seal member 6*b* is pressed against the developing roller 2 becomes larger on the downstream side of the seal member 6*b*. Thus, it becomes possible to reduce the pressure with which the seal member 6*b* is pressed against the developing roller 2 as a whole, without deteriorating the sealing performance. Moreover, the toner is kept in the contact portion between the seal member 6*b* and the developing roller 2 without being scraped off, and therefore it is not necessary to form a hole or a cutout portion for ejecting the scraped toner, with the result that the seal member 6*b* is not easily broken or separated. Furthermore, it is not necessary to provide separate seal members respectively on the upstream and downstream sides along the rotational direction of the developing roller 2, and therefore the deterioration of the sealing effect because of the displacement of the seal members does not occur.

In addition, according to Embodiment 2, the thickness of the seal member 6*b* is substantially uniform, and therefore the manufacturing process of the seam member 6*b* becomes easy and the manufacturing cost can be reduced.

Embodiment 3

Figure 8A:
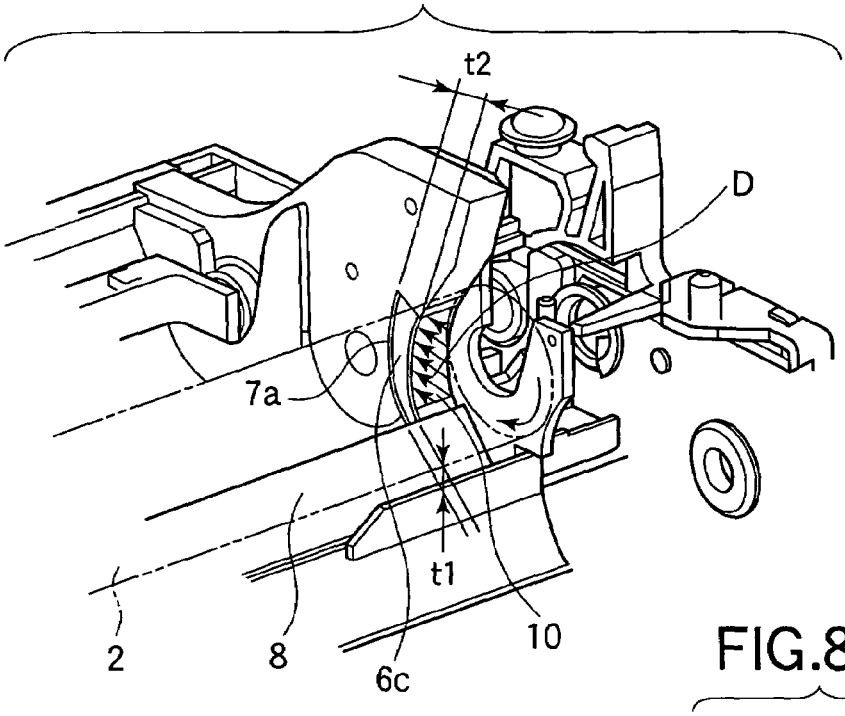
FIGS. 8A is a perspective view showing a seal member mounted in an image forming apparatus according to Embodiment 3 of the present invention.

FIG. 8A is a perspective view of a seal member 6*c* mounted in an image forming apparatus according to Embodiment 3. In Embodiment 3, the seal member 6*c* is used instead of the seal member 6*a* (FIG. 2) of Embodiment 1. Other components of Embodiment 3 are the same as those of Embodiment 1. As was described in Embodiment 1, the thickness of the seal member 6*c* continuously increases from t1 to t2 (t2>t1) along the rotational direction of the developing roller 2 from the upstream to the downstream, so that the compressed amount of the compressed portion of the seal member 6*c* increases along the rotational direction of the developing roller 2 from the upstream to the downstream. The pressure P1 at the upstream end of the seal member 6*c* is preferably from 0 to 15 kgf/cm$^2$ (i.e., from 0 to 1.47 MPa), and the pressure P2 at the downstream end of the seal member 6*c* is preferably from 25 to 80 kgf/cm$^2$ (i.e., from 2.45 to 7.84 MPa).

Figure 8B:
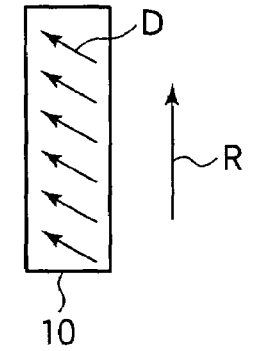
FIG. 8B is a front view showing orientations of fibers on the seal member shown in FIG. 8A.

In Embodiment 3, fibers 10 are bonded to the surface of the seal member 6*c* contacting the circumferential surface of the developing roller 2. FIG. 8B is a front view of the fibers 10 on the surface of the seal member 6*c* seen from the developing roller 2 side. As shown in FIG. 8B, the fibers 10 extend in substantially one direction D which is inclined inwardly (i.e., toward the interior of the toner storing portion 1) by a predetermined angle with respect to the rotational direction R of the developing roller 2.

When the developing roller 2 rotates, the toner adhering to the circumferential surface of the end portion of the developing roller 2 easily enters into a contact portion between the seal member 6*c* and the circumferential surface of the developing roller 2.

At the upstream part of the seal member 6*c*, the pressure of the seal member 6*c* is relatively small as described above, and therefore the toner having entered into the contact portion moves toward the downstream side of the seal member 6*c* without leaking out of the contact portion. The toner having entered into the contact portion stays where a force urging the toner to the downstream side is balanced with another force (caused by the pressure of the seal member 6*c*) preventing the movement of the toner. Further, in Embodiment 3, the toner having entered into the contact portion is guided by the fibers 10 (on the surface of the seal member 6*c*) in the direction inclined inwardly with respect to the rotational direction of the developing roller 2, and therefore the toner returns to the toner storing portion 1.

According to Embodiment 3, the thickness of the seal member 6*c* continuously increases along the rotational direction of the developing roller 2 from the upstream to the downstream, with the result that the pressure with which the seal member 6*c* is pressed against the developing roller 2 becomes larger on the downstream side of the developing roller 2. Thus, it becomes possible to reduce the pressure with which the seal member 6*c* is pressed against the developing roller 2 as a whole, without deteriorating the sealing performance. Further, because the fibers 10 are bonded on the contact surface of the seal member 6*c* contacting the circumferential surface of the developing roller 2, and the fibers 10 guide the toner in the direction in which the toner returns to the toner storing portion 1. Therefore, the sealing effect can be further enhanced. Moreover, the toner is kept in the contact portion between the seal member 6*c* and the developing roller 2 without being scraped off, and therefore it is not necessary to form a hole or a cutout portion for ejecting the scraped toner, with the result that the seal member 6*c* is not easily broken or separated. Furthermore, it is not necessary to provide separate seal members respectively on the upstream and downstream sides along the rotational direction of the developing roller 2, and therefore the deterioration of the sealing effect because of the displacement of the seal members does not occur.

Embodiment 4

Figure 9:
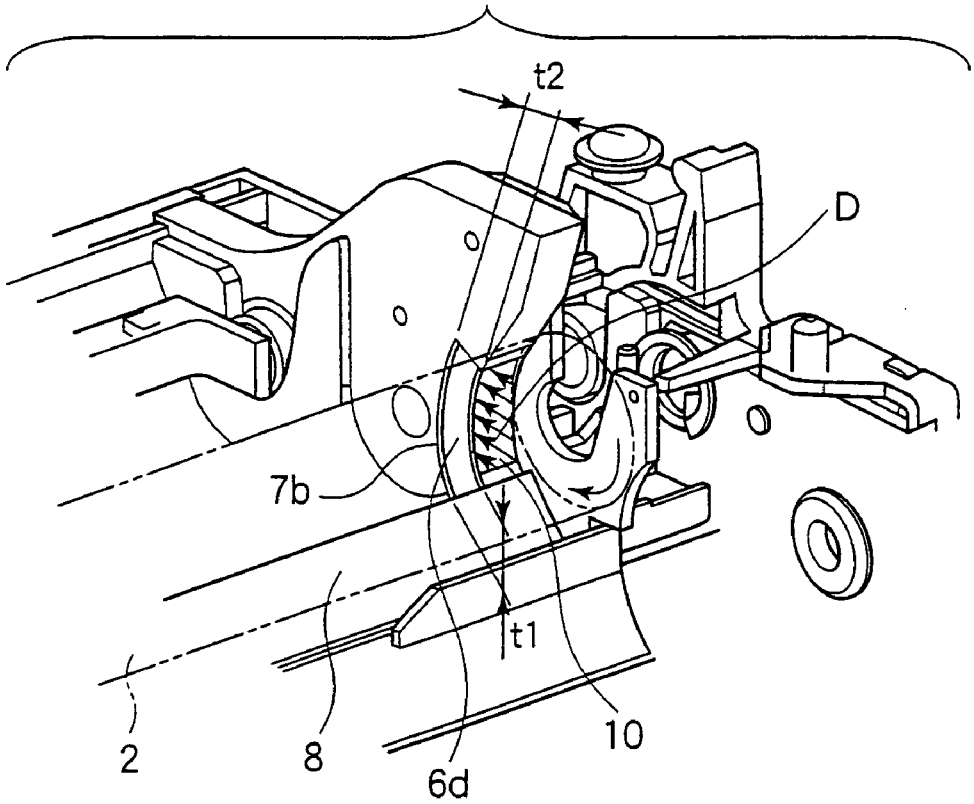
FIG. 9 is a perspective view showing the seal member mounted in the image forming apparatus according to Embodiment 4 of the present invention.
Figure 10:
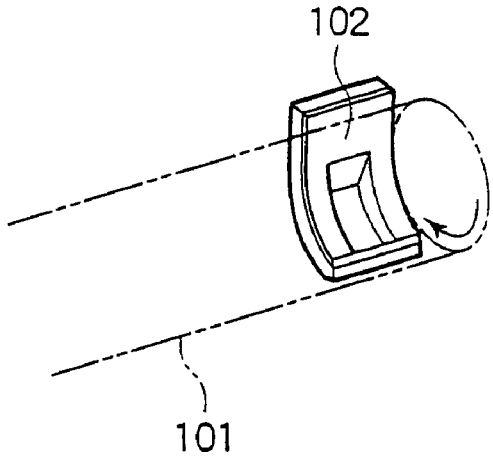
CONVENTIONAL ART FIG.10
FIG. 10 is a perspective view showing a conventional seal member that contacts a circumferential surface of a developing roller.
Figure 11:
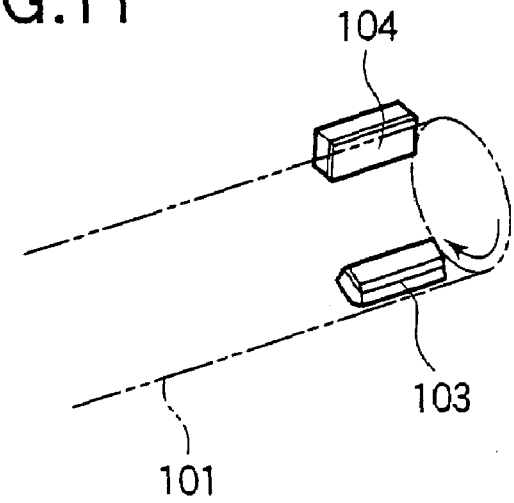
CONVENTIONAL ART FIG.11
FIG. 11 is a perspective view of conventional upstream and downstream seal members that contact a circumferential surface of the developing roller.
Figure 12:
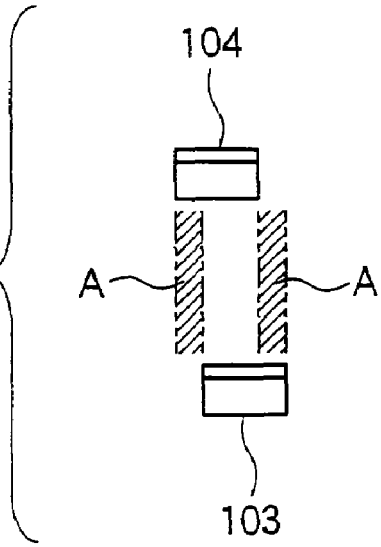
CONVENTIONAL ART FIG.12
FIG. 12 is a schematic view showing the state where the positions of the upstream and downstream seal members are displaced from each other.

FIG. 9 is a perspective view of a seal member 6*d* mounted in an image forming apparatus according to Embodiment 4. In Embodiment 4, the seal member 6*d* is used instead of the seal member 6*b* (FIG. 2) of Embodiment 2. Other components of Embodiment 2 are the same as those of Embodiment 2. Other components of Embodiment 2 is the same as those of Embodiment 2.

As was described in Embodiment 2, the thickness of the seal member 6*d* does not change along the rotational direction of the developing roller 2 from the upstream to the downstream. In other words, the thickness t1 and t2 of the upstream and the downstream sides of the seal member 6*d* are substantially the same. As was described in Embodiment 2, the bonding surface 7*b* of the side plate 7 is so shaped that the distance between the bonding surface 7*b* and the rotation axis of the developing roller 2 continuously decreases along the rotational direction of the developing roller 2 from the upstream to the downstream. Thus, in a state where the seal member 6*d* is not compressed by the developing roller 2, the distance between the contact surface of the seal member 6*d* and the rotation axis of the developing roller 2 continuously decreases along the rotational direction of the developing roller 2 from the upstream to the downstream. With such a structure, the compressed amount of a compressed portion of the seal member 6*d* increases along the rotational direction of the developing roller 2 from the upstream to the downstream. The pressure P1 at the upstream end of the seal member 6*d* is preferably from 0 to 15 kgf/cm$^2$ (i.e., from 0 to 1.47 MPa), and the pressure P2 at the downstream end of the seal member 6*d* is preferably from 25 to 80 kgf/cm$^2$ (i.e., from 2.45 to 7.84 MPa).

In Embodiment 4, fibers 10 are bonded to the contact surface of the seal member 6*d* contacting the circumferential surface of the developing roller 2, as was described in Embodiment 3. The fibers 10 extend in substantially one direction which is inclined inwardly (toward the interior of the toner storing portion 1) by a predetermined angle with respect to the rotational direction of the developing roller 2.

According to Embodiment 4, the distance between the contact surface of the seal member 6*d* (in a state where the seal member 6*d* is not compressed) and the rotation axis of the developing roller 2 continuously decreases along the rotational direction of the developing roller 2 from the upstream to the downstream, with the result that the pressure with which the seal member 6*d* is pressed against the developing roller 2 becomes larger on the downstream side of the seal member 6*b*. Thus, it becomes possible to reduce the pressure with which the seal member 6*d* is pressed against the developing roller 2 as a whole, without deteriorating the sealing performance. Further, the fibers 10 on the surface of the seal member 6*d* guide the toner in the direction in which the toner returns into the toner storing portion 1, and therefore the sealing effect can be further enhanced. Moreover, the toner is kept in the contact portion between the seal member 6*d* and the developing roller 2 without being scraped off, and therefore it is not necessary to form a hole or a cutout portion for ejecting the scraped toner, with the result that the seal member 6*d* is not easily broken or separated. Furthermore, it is not necessary to provide seal members respectively on the upstream and downstream sides along the rotational direction of the developing roller 2, and therefore the deterioration of the sealing effect because of the displacement of the seal members does not occur.

In addition, according to Embodiment 4, the thickness of the seal member 6*d* is substantially uniform, and therefore the manufacturing process of the seal member 6*d* becomes easy and the manufacturing cost can be reduced.

In Embodiments 3 and 4, the fibers 10 can be composed of, for example, a felt made of fluororesin. For example, Teflon (registered trademark of DuPont), i.e., polytetrafluoroethylene is used. Alternatively, the fibers 10 can be composed of polyester fibers.

If the fibers 10 are composed of Teflon felt having an excellent sliding property, the friction between the fibers 10 and the developing roller 2 can be reduced. Therefore, in addition to the effect of preventing the leakage of the toner, it becomes possible to restrict the abrasion of the developing roller 2 and to reduce the load torque for rotating the developing roller 2.

If the fibers 10 are composed of polyester fibers having an excellent abrasion resistance and endurance, it becomes possible to lengthen the lifetime of the developing device, in addition to the effect of preventing the leakage of the toner.

Although the above description is made to one seal member (6*a*, 6*b*, 6*c* or 6*d*), two seal members (6*a*, 6*b*, 6*c* or 6*d*) are provided on both ends of the developing roller 2 in a symmetrical manner. Similarly, two side seal members 9 are provided on both ends of the developing roller 2 in a symmetrical manner, as well as side plates 7.

The present invention can be applied to a printer, a facsimile, a copier, a complex device having a plurality of functions or the like using the developing roller.

While the preferred embodiments of the present invention have been illustrated in detail, it should be apparent that modifications and improvements may be made to the invention without departing from the spirit and scope of the invention as described in the following claims.

What is claimed is:

1. A developing device for developing a latent image formed on a photosensitive body, said developing device comprising:

a developing roller that rotates to supply a developer to said photosensitive body, and at least one seal member that slidably contacts a circumferential surface of at least one end portion of said developing roller, wherein said at least one seal member contacts said developing roller with a contact length longer than or equal to one fifth of the circumference of said developing roller, and wherein, along said contact length, a pressure with which said at least one seal member is pressed against said circumferential surface of said developing roller continuously increases in a rotational direction of said developing roller from the upstream to the downstream.

2. The developing device according to claim 1, wherein said seal member includes a resilient member, and a resilient force of said seal member applied to said developing roller increases along said rotational direction of said developing roller from said upstream to said downstream.

3. The developing device according to claim 2, wherein the thickness of said seal member continuously increases along said rotational direction of said developing roller from said upstream to said downstream.

4. The developing device according to claim 2, wherein the distance between a contact surface of said seal member contacting said developing roller and a rotation axis of said developing roller continuously decreases along said rotational direction of said developing roller from said upstream to said downstream in an uncompressed state in which said developing roller is not mounted to said developing device.

5. The developing device according to claim 1, further comprising fibers provided on a contact surface of said seal member contacting said developing roller.

6. The developing device according to claim 5, wherein said fibers are composed of a felt made of fluororesin.

7. The developing device according to claim 5, wherein said fibers are made of polyester.

8. The developing device according to claim 5, wherein fibers substantially extend in a direction inclined toward an interior of said developing device by a predetermined angle with respect to a rotational direction of said developing roller from said upstream side to said downstream.

9. An image forming apparatus comprising:

a photosensitive body;

a latent image forming device that forms a latent image on said photosensitive body;

said developing device according to claim 1;

a transferring device that transfers a developer image developed by said developing device to a recording medium, and a fixing device that fixes said developer image to said recording medium.

10. The developing device according to claim 2, wherein said seal member is so supported that the compressed amount of said seal member continuously increases in said rotational direction of said developing roller from the upstream to the downstream.

11. The developing device according to claim 1, wherein, along said contact length, said pressure continuously increases in said rotational direction of said developing roller from the upstream end to the downstream end, and wherein said pressure is within a range from 0.00 to 1.47 MPa at the upstream end, and within a range of 2.45 to 7.84 MPa at the downstream end.

12. A developing device for developing a latent image formed on a photosensitive body, said developing device comprising:

a developing roller that rotates to supply a developer to said photosensitive body, and at least one seal member that slidably contacts a circumferential surface of at least one end portion of said developing roller, wherein said seal member contacts said developing roller so that a contact area between said seal member and said developing roller extends across the entire area in which said developing roller faces the interior of a toner storing portion of said developing device, and wherein, over said contact area, a pressure with which said seal member is pressed against said circumferential surface of said developing roller continuously increases in a rotational direction of said developing roller from the upstream to the downstream.

13. The developing device according to claim 12, wherein said seal member includes a resilient member, and a resilient force of said seal member applied to said developing roller increases along said rotational direction of said developing roller from said upstream to said downstream.

14. The developing device according to claim 13, wherein the thickness of said seal member continuously increases along said rotational direction of said developing roller from said upstream to said downstream.

15. The developing device according to claim 13, wherein the distance between a contact surface of said seal member contacting said developing roller and a rotation axis of said developing roller continuously decrease along said rotational direction of said developing roller from said upstream to said downstream in a state where said developing roller is not mounted to said developing device.

16. The developing device according to claim 12, further comprising fibers provided on a contact surface of said seal member contacting said developing roller.

17. The developing device according to claim 16, wherein said fibers are composed of a felt made of fluororesin.

18. The developing device according to claim 16, wherein said fibers are made of polyester.

19. The developing device according to claim 16, wherein fibers substantially extend in a direction inclined toward an interior of said developing device by a predetermined angle with respect to a rotational direction of said developing roller from said upstream side to said downstream.

20. An image forming apparatus comprising:

a photosensitive body;

a latent image forming device that forms a latent image on said photosensitive body;

said developing device according to claim 12;

a transferring device that transfers a developer image developed by said developing device to a recording medium, and a fixing device that fixes said developer image to said recording medium.

21. The developing device according to claim 13, wherein said seal member is so supported that the compressed amount of said seal member continuously increases in said rotational direction of said developing roller from the upstream to the downstream.

22. The developing device according to claim 12, wherein, over said contact area, said pressure continuously increases in said rotational direction of said developing roller from the upstream end to the downstream end, and wherein said pressure is within a range from 0.00 to 1.47 MPa at the upstream end, and within a range of 2.45 to 7.84 MPa at the downstream end.

* * * * *